US008881418B2

(12) United States Patent
Funk

(10) Patent No.: US 8,881,418 B2
(45) Date of Patent: Nov. 11, 2014

(54) MECHANCIAL SPACING APPARATUS

(76) Inventor: William E. Funk, Surrey (CA)

( * ) Notice: Subject to any disclaimer, the term of this patent is extended or adjusted under 35 U.S.C. 154(b) by 218 days.

(21) Appl. No.: 13/443,751

(22) Filed: Apr. 10, 2012

(65) Prior Publication Data

US 2013/0263462 A1 Oct. 10, 2013

(51) Int. Cl.
*G01B 1/00* (2006.01)

(52) U.S. Cl.
USPC ..... 33/526; 33/567; 33/527; 33/562; 33/613; 33/524; 33/180; 33/168; 33/474; 33/67

(58) Field of Classification Search
USPC ..... 33/526, 567, 527, 562, 613, 524, 180, 33/168, 474, 67
See application file for complete search history.

(56) References Cited

U.S. PATENT DOCUMENTS 2,382,618 A * 8/1945 Douglass ..... 33/456
3,735,497 A * 5/1973 Boettcher ..... 33/526
4,862,668 A * 9/1989 DeGooyer ..... 52/747.11
5,109,611 A * 5/1992 Houck ..... 33/613
5,456,015 A * 10/1995 Butcher et al. ..... 33/451
6,851,201 B1 * 2/2005 Gioia et al. ..... 33/479
7,003,891 B1 * 2/2006 Diggle et al. ..... 33/471

OTHER PUBLICATIONS

AV2 Spacer for laying solid wood, and laminate flooring without any wedges. Announcement [online]. Bessey Tools North America, 2012 [retrieved on Jan. 23, 2014]. Retrieved from the Internet: <http://www.besseytools.com/pdfs/sales_sheets/en/BESSEYAV2Spacer_Eng_Mar22_2012.pdf>.*

* cited by examiner

*Primary Examiner* — Peter Macchiarolo
*Assistant Examiner* — Rhyan C Lange
(74) *Attorney, Agent, or Firm* — Davis & Bujold, PLLC; Michael J. Bujold

(57) ABSTRACT

A mechanical spacing apparatus for placement between a vertical dry wall member and a horizontal flooring panel. The flooring panel and the dry-wall member meet at right angles. The spacing apparatus comprises a horizontal front projecting element for placement on the top surface of the flooring panel joined to a vertical upwards projecting element for abutting adjacent to the vertical dry-wall member. The spacing apparatus comprises horizontal and vertical elements at right angles. Projecting vertically downwards from the right angle join between the horizontal and vertical elements is a spacing element having a predetermined thickness for creating a suitable spacing distance between the inward edge of the flooring panel and the bottom of the vertical dry-wall member thereby accommodating a suitable expansion distance for the flooring installation. The apparatus is easily installed and removed by hand by a flooring installer.

7 Claims, 8 Drawing Sheets

FIGURE 3
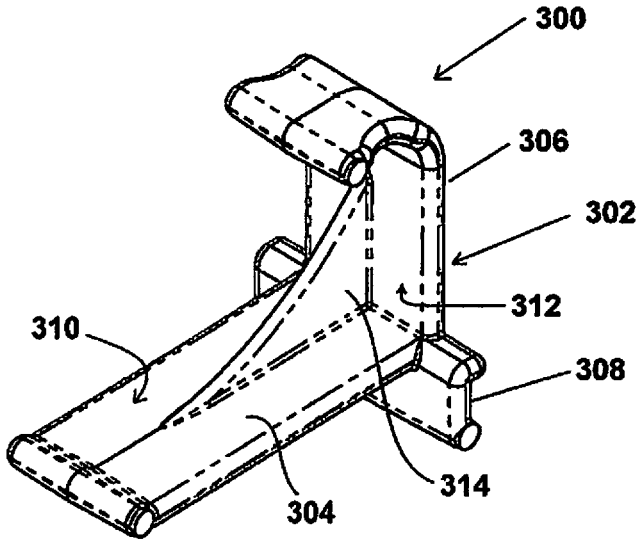
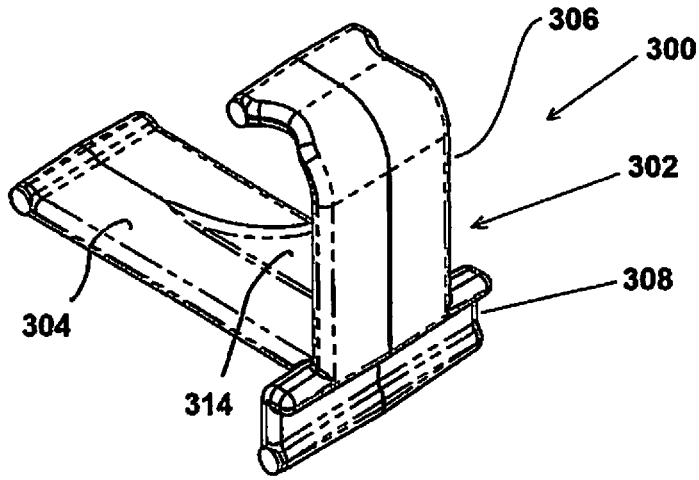
FIGURE 4

FIGURE 5
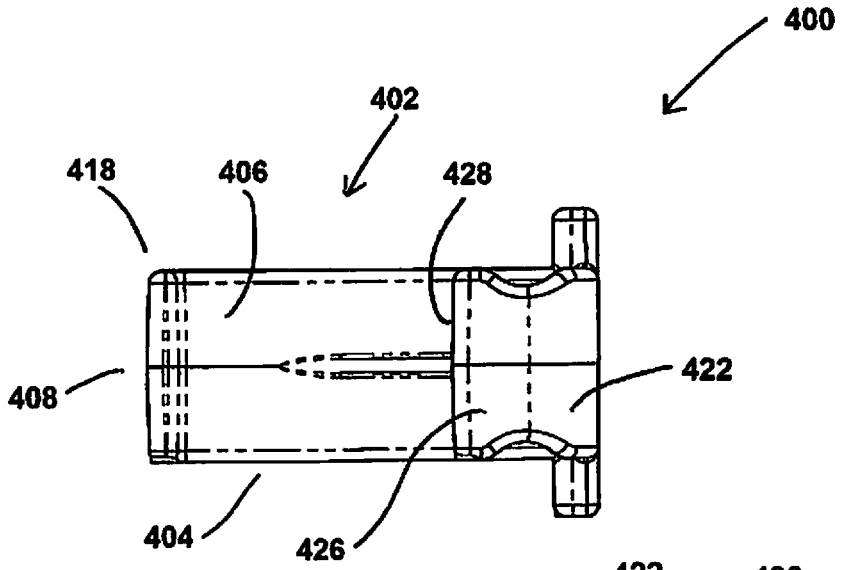
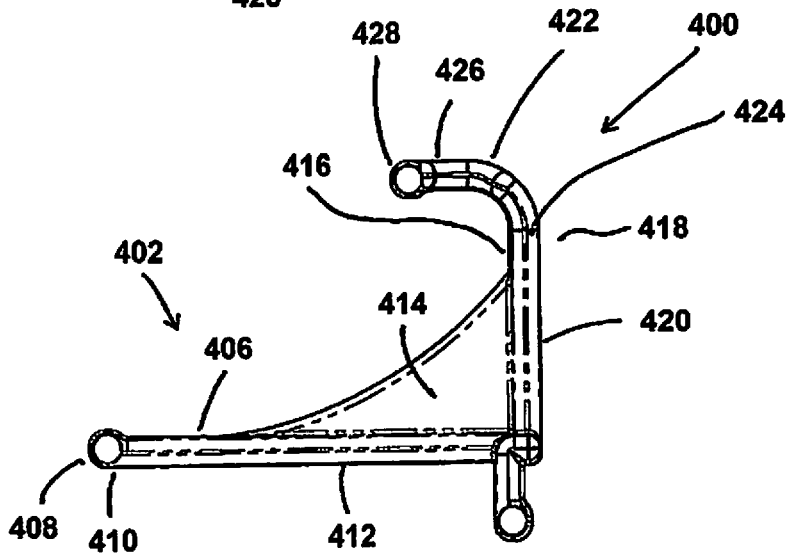
FIGURE 6

MECHANCIAL SPACING APPARATUS

BACKGROUND OF THE INVENTION

1. Field of the Invention

This invention is related to flooring systems wherein the flooring is installed as a series of interlocking panels. The flooring system can comprise solid hardwood, engineered wood, or a laminate design. Specifically the invention relates to a mechanical spacing apparatus for placement between an edge flooring panel and an adjacent wall where there is required a suitable distance to accommodate floor expansion.

2. Discussion of the Prior Art

It is well known in the art of panel flooring systems that these systems, once installed, expand and contract with the ambient temperature of the room in which they are installed. Therefore there is a requirement to provide a suitable expansion space to accommodate the accumulated expansion of each individual member of the flooring system. Without the expansion joint the individual interlocked flooring panels will buckle creating undesirable results in the flooring surface. If the horizontal floor is laid on a Cartesian coordinate system, the expansion will occur in the x and y axis directions. Therefore, an expansion joint is provided at the edge of the flooring system adjacent to the walls. Putting the expansion joint against the wall permits the expansion joint to be hidden underneath a baseboard of suitable thickness.

Furthermore, it is also known that adjacent vertical dry-wall panels may not be in contact with the floor surface and may be suspended above the surface as a result of being hung on vertical studs. This makes it difficult to secure prior art spacers around the perimeter of the wall since there is no material against which to wedge the spacer.

Prior art expansion joints include wooden and metallic shims. One disadvantage of the shim type spacer is that if the vertical dry-wall member does not reach the floor surface the bottom tip of the shim may tilt into the space between the bottom of the dry-wall member and the floor itself thereby creating an inaccurate expansion distance.

While there are a number of different spacer designs available there are none that ensure a consistent spacing along the length of the floor edge particularly where the dry-wall member does not extend to the bottom of the floor.

SUMMARY OF THE INVENTION

One object of the invention is to provide an improved spacer to ensure an adequate expansion joint in the installation of paneled flooring systems.

Another object of the invention is to provide a spacer which is inexpensive to manufacture and reusable.

A further object of the invention is to provide a spacer which can be manufactured from recycled materials.

Still another object of the invention is to provide a spacer which is easily installed and removed using a single finger pull.

Yet another object of the invention is to provide a spacer for a suitable expansion joint where the dry-wall vertical member does not reach the floor.

In summary, the invention is a spacing apparatus for creating a properly dimensioned expansion joint during the installation of a paneled flooring system. The apparatus comprises a body with a bottom frontward projecting horizontal element for placement on a surface of a panel of a paneled flooring system and for providing stability in an x-direction. There is also an upward projecting vertical element for placement against a vertical wall member for providing stability in a y-direction. A downward projecting spacing element is joined to the body for placement between a wall-adjacent edge of the panel and a bottom end of the vertical wall member thereby creating a properly dimensioned expansion joint.

In one embodiment of the invention there is further included a flange element disposed connectively between a top surface of the bottom frontward projecting member and a front face of the upward projecting vertical element. The flange element provides rigidity to the apparatus.

In another embodiment of the invention the body of the apparatus comprises a single moulded body from a rigid suitable thermoplastic.

In yet another embodiment of the invention there is a top frontward projecting horizontal element for hand and finger grasping for installation and removal of the apparatus. A curved element is disposed between a top end of the upward projecting vertical element and an end of the top forward projecting horizontal element. The top forward projecting horizontal element comprises a first concave indentation on a first side and an opposite second concave indentation on a second side for finger grasping of the apparatus.

The downward projecting spacing element has a width that is substantially greater than the width of the bottom frontward projecting element to prevent the apparatus from twisting when installed in an expansion gap. The downward projecting element has a top end that is joined to a bottom surface of the bottom frontward projecting horizontal element at a point that is inset a distance from a back surface of the upward projecting member thereby creating a suitable wall offset distance that ensures a proper expansion gap.

BRIEF DESCRIPTION OF THE DRAWINGS

1.
FIG. 3 is a front perspective view of one embodiment of the invention.
4.
FIG. 4 is a rear perspective view of the embodiment shown in FIG. 3.
5.
FIG. 5 is a top view of one embodiment of the invention.
6.
FIG. 6 is a side view of the embodiment of the invention shown in FIG. 5.
7.

DETAILED DESCRIPTION OF A PREFERRED EMBODIMENT

The invention relates to a mechanical spacing apparatus for ensuring a properly dimensioned expansion joint during the installation of flooring system comprising flooring panels.

Figure 1:
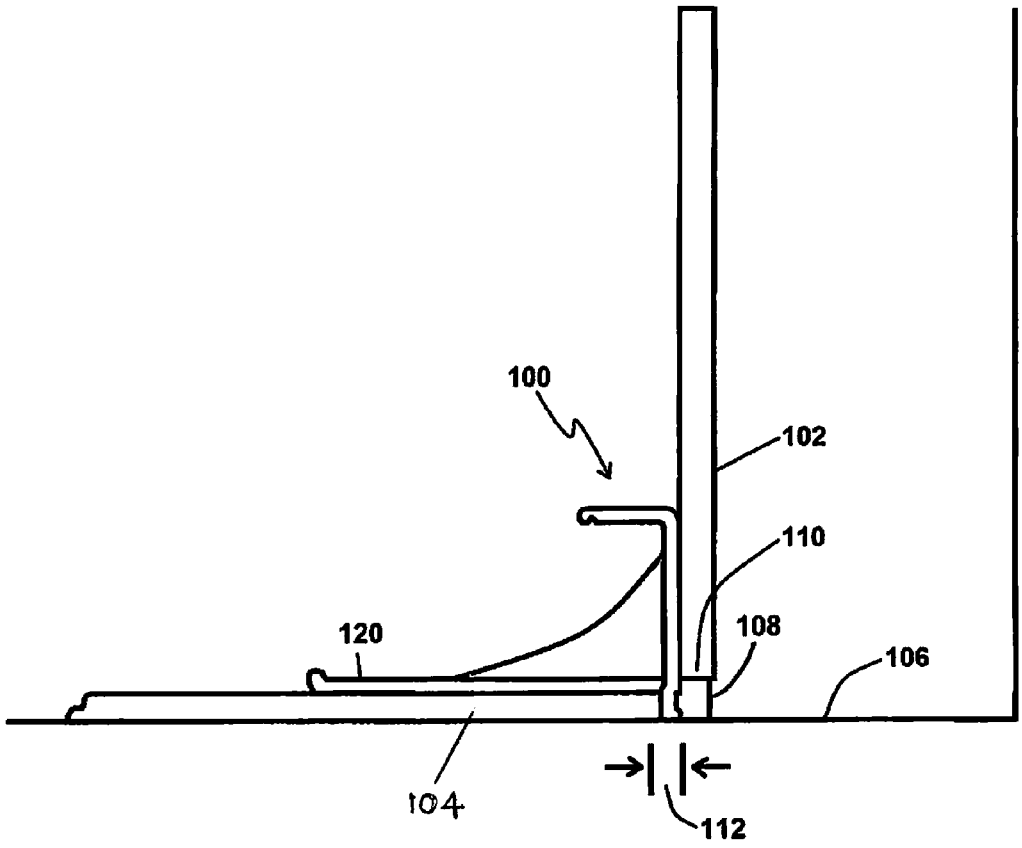
FIG. 1 illustrates one embodiment of the invention in side view as installed in a typical panelled flooring system.
2.

Now referring to FIG. 1 there is shown a side view of the invention 100 which is disposed between the dry-wall vertical member 102 and the edge member of the laminate flooring system 104. Note that in this depicted installation the dry-wall member 102 does not reach the surface of the floor 106 and therefore leaves a gap 108 between the bottom 110 of the dry-wall vertical member 102 and the surface of the floor 106. In this installation the illustrated embodiment of the invention 100 has one advantage that is is to ensure that the desired expansion joint distance 112 is maintained without the apparatus collapsing into the gap 108 as may occur if a wooden shim were placed into the gap 112.

Figure 2:
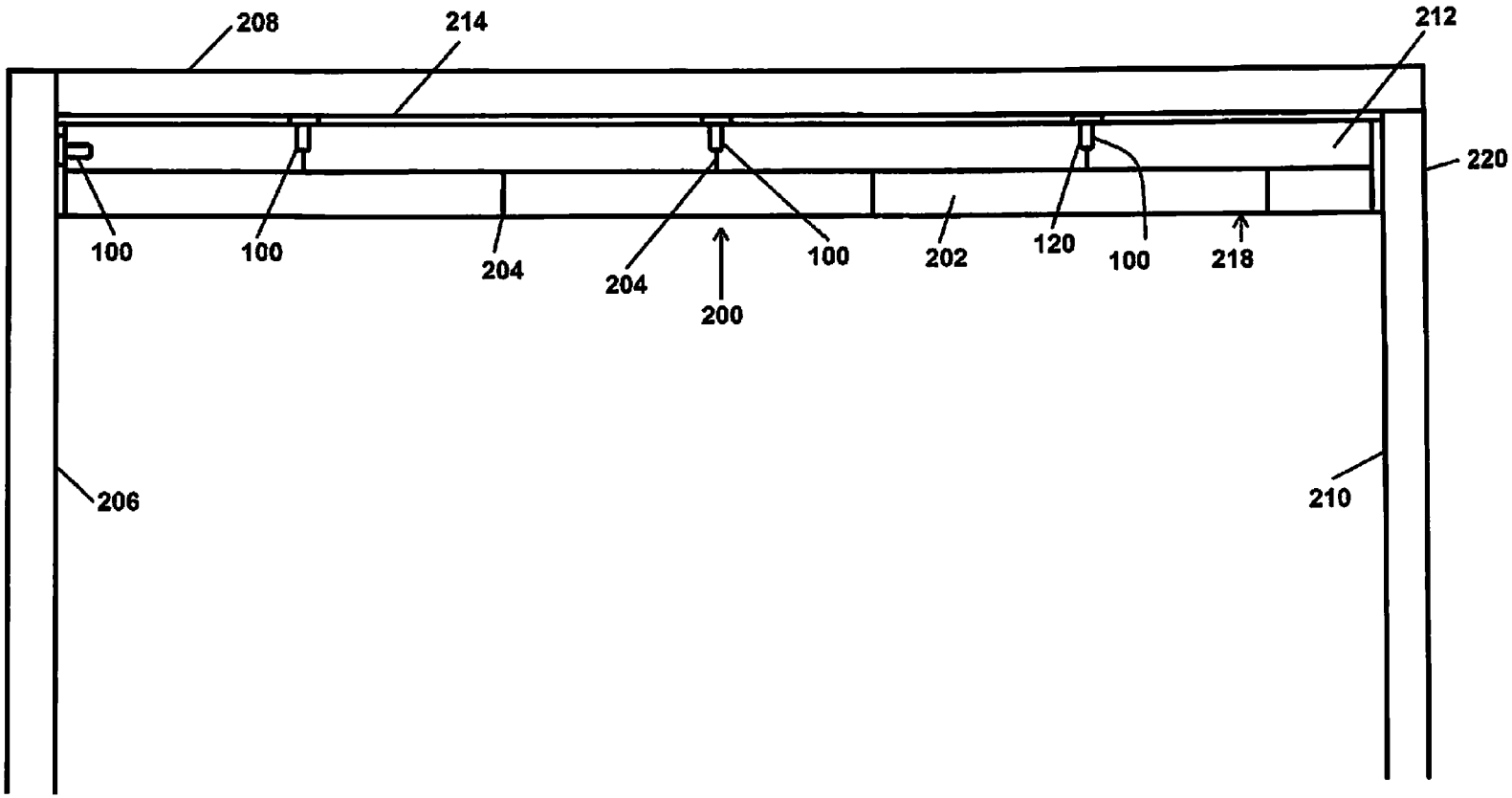
FIG. 2 illustrates a flooring system installation from a top view showing the spacing of one embodiment of the invention.
3.

Referring to FIG. 2 there is shown a top view of a paneled floor installation 200 comprising a plurality of floor panels 202 having joints 204 between them. Also shown are three walls of a room 206, 208 and 210. In the initial stages of the floor installation a first row of panels 212 will be laid adjacent to a wall 208 and a suitable expansion gap 214 will be created using the spacing apparatus of the invention 100. Note that another advantage of the invention 100 is that the horizontal member of the invention shown in FIG. 1 as 120 and in FIG. 2 as 120 can be placed over an expansion joint 204 thereby providing support to the flooring members and allowing the installer to apply forces to the installation edge 218 of the second row of panels 220 without distorting the even spacing of the expansion distance 214.

Referring now to FIG. 3 and FIG. 4 there is shown one embodiment of the invention 300 in a front perspective view and rear perspective view respectively. The apparatus of the invention comprises a single molded body 302 of a suitable thermoplastic comprising the following elements: a frontward bottom projecting horizontal element 304, an upward projecting vertical element 306 and a downward projecting element 308 which acts as the spacing member. Between the upper surface 310 of the frontward bottom projecting horizontal element 304 and the front-facing surface 312 of upward projecting vertical element 306 there is disposed a connected flange element 314 that adds rigidity to the body of the invention 302 and ensures that the horizontal element 304 and the vertical element 306 remain at right angles.

Referring now to FIG. 5 and FIG. 6 there is shown an embodiment 400 of the invention in a top view and side view respectively. In the embodiment shown, invention body 402 comprises frontward projecting horizontal element 404 having a top surface 406. The front edge 408 of the element 404 terminates in a barrel-shaped tip 410. The bottom surface 412 of element 404 is flat and smooth so that it will lie flat against the upper surface of the flooring panel member upon which it is situated. Flange element 414 is disposed between the upper surface 406 of element 404 and the front face 416 of vertical projecting element 418.

Referring to FIG. 6 the rear surface 420 of the upward projecting element 418 is also flat and smooth so that it can be set against the vertical wall as shown in FIG. 1. Other features of the apparatus 400 include a curved element 422 between the top end 424 of the upward projecting element 418 and a top horizontal frontward projecting element 426 which is parallel to bottom frontward projecting element 404. Element 426 also terminates in a tip that is slightly barrel shaped 428.

Figures 7, 8:
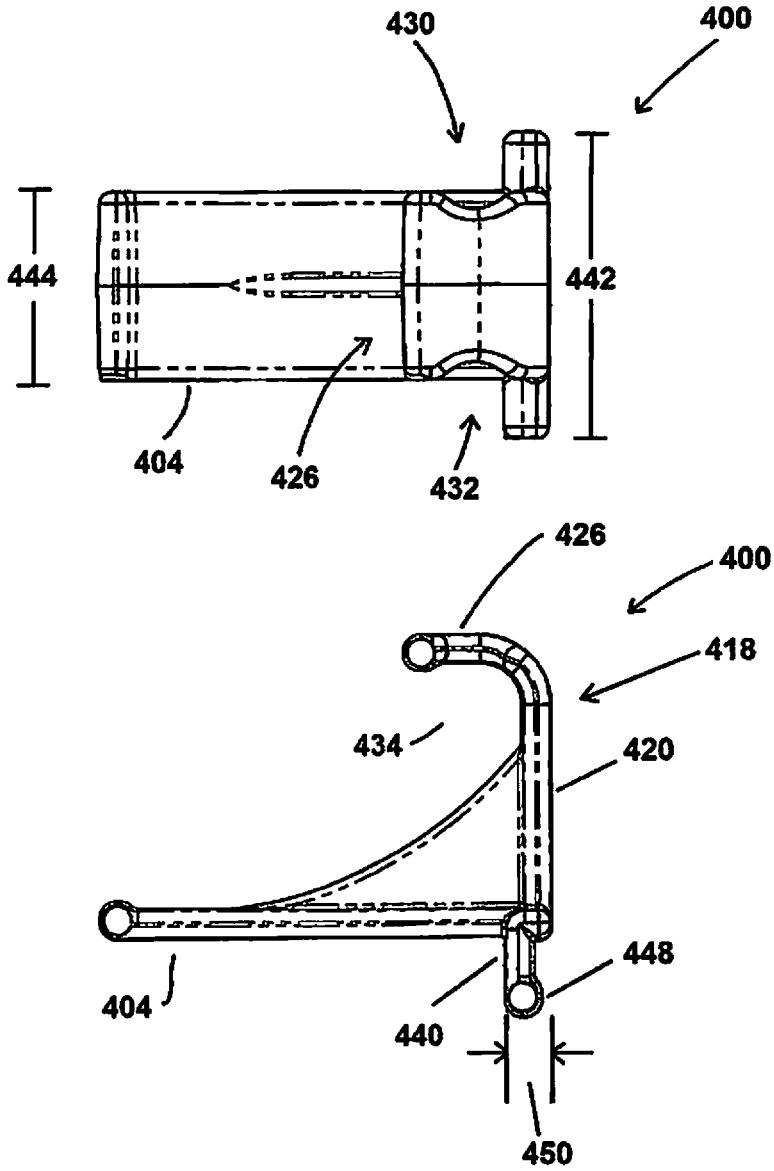
FIG. 7 is a top view of the same embodiment as shown in FIG. 5.
8.
FIG. 8 is a side view of the embodiment as shown in FIG. 6.
9.

Referring now to FIG. 7 and FIG. 8 there are shown the same two drawings as in FIG. 5 and FIG. 6 respectively. Referring to FIG. 7 which is a top view of the invention 400 there is shown indentations 430 and 432 in the top horizontal forward projecting element 426. These two projections permit grasping by thumb and index finger for placement and removal of the apparatus from its installed position or, alternatively, the use of a single finger placed within the concavity 434 of the apparatus so that a single finger is able to pull the apparatus from its installed position.

Still referring to FIG. 7 and FIG. 8 there is further illustrated the downward projecting spacing element 440. Element 440 has a width 442 that is substantially wider than the width 444 of element 404. Width 442 of the bottom projecting element 440 ensures that the expansion spacing required for the floor installation is accurate and will prevent the body of the invention 400 from twisting. The bottom end of downward projecting element 440 terminates in a slightly barrelled shape tip 448. The downward projecting element 440 is inset a predetermined amount 450 from the rear face 420 of the upward projecting element 418 so as to create the proper width of the desired expansion joint as illustrated in FIG. 1 and FIG. 2. Distance 450 is called a wall offset distance and is generally about $^{1}$A of an inch for most flooring installations.

Figure 9:
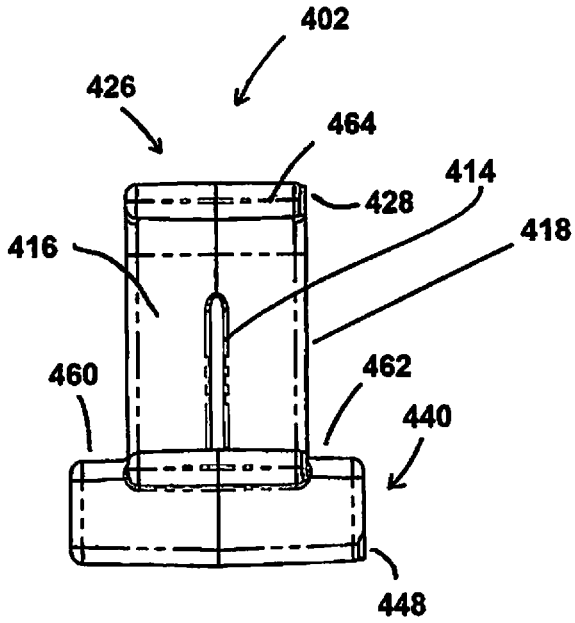
FIG. 9 is a front view of one embodiment of the invention.
10.
Figure 10:
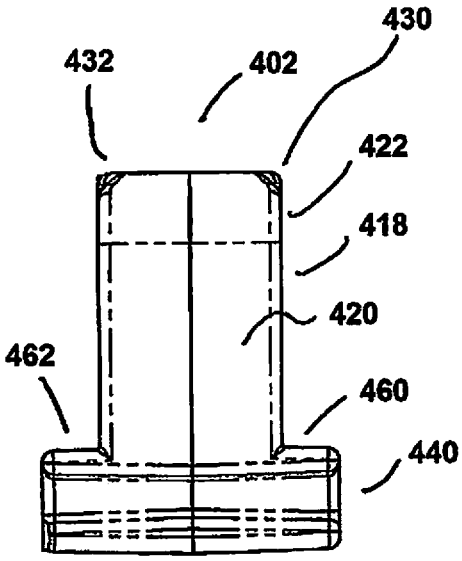
FIG. 10 is a rear view of the embodiment shown in FIG. 9.

Referring now to FIG. 9 and FIG. 10 there is shown a front view and rear view respectively of the body of the invention 402. The front view in FIG. 9 illustrates the downward projecting element 440 having a bottom tip 448 that is slightly barrel shaped. FIG. 9 also illustrates the left 460 and the right 462 top shoulders of the downward projecting element 440. Between the shoulders is the base of upward projecting member 418. The front tip 464 of the top horizontal projecting element 426 also has a tip that is slightly barreled shape. Flange element 414 is shown disposed and connected between the top surface 406 of the bottom projecting element 404 and the front face 416 of the vertical upwards projecting element 418.

Referring to FIG. 10 there is illustrated illustrates a back view of the body 402 of the invention. FIG. 10 illustrates the flat and smooth back surface 420 of the upward projecting vertical element 418, curved element 422 and the commencement of the left 432 and right 430 finger indentations. The downward depending spacing element 440 is also illustrated having top shoulders 462 and 460.

Figure 11:
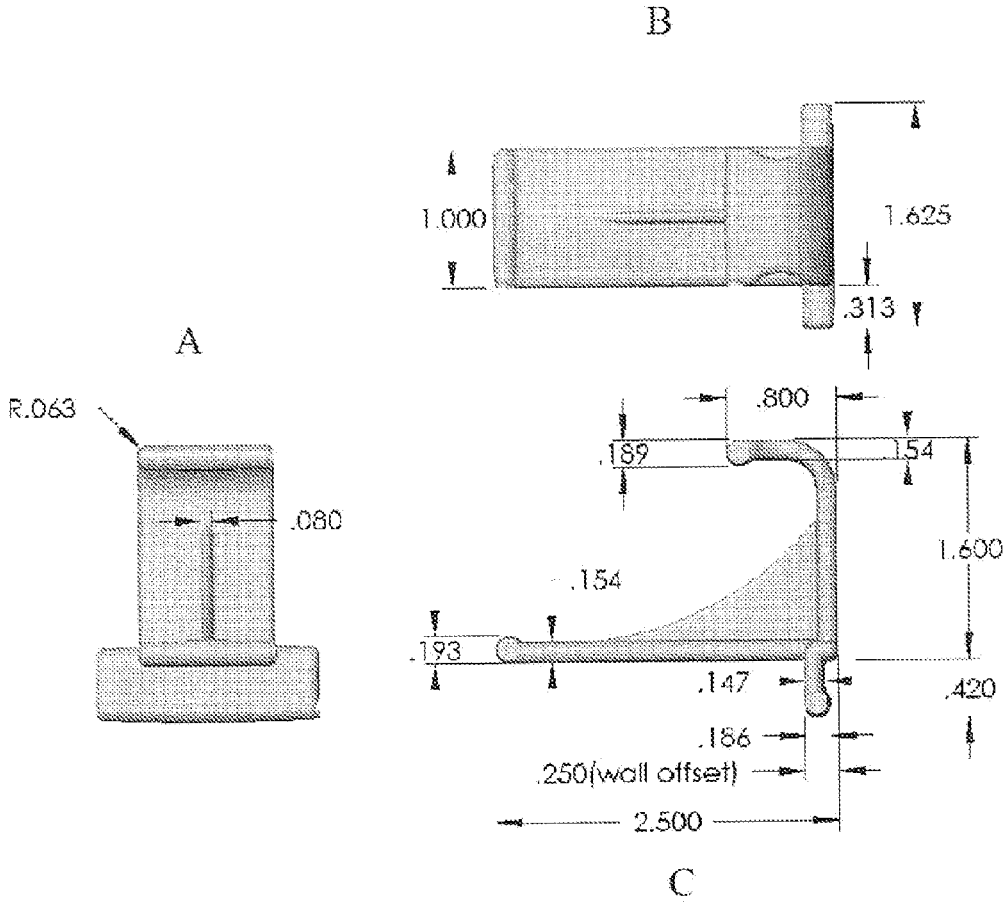
FIGS. 11A to 11C respectively are front, top and side views of one embodiment of the invention with exemplary dimensions.

Referring to FIGS. 11A to 11C there is shown one embodiment of the invention with dimensions that are exemplary only.

The preceding description has been presented only to illustrate and describe possible embodiments of the present exemplary apparatus. It is not intended to be exhaustive or to limit the apparatus to any precise form disclosed. Many modifications and variations are possible in light of the above teaching. It is intended that the scope of the present invention be defined by the following claims.

What is claimed is:

1. A spacing apparatus for creating a properly dimensioned expansion joint during the installation of a paneled flooring system, said apparatus comprising:

a body comprising a bottom frontward projecting horizontal element, joined to an upward projecting vertical element and a downward projecting spacing element;

the bottom frontward projecting horizontal element having a uniform width and the downward projecting spacing element having a width that is greater than the width of the bottom frontward projecting element;

the downward projecting element has a top end that is joined to a bottom surface of the bottom frontward projecting horizontal element at a point that is inset a distance equal to an intended expansion gap from a back surface of the upward projecting member; and a grasping element curved forwardly from a top end of the upward projecting vertical element and projectng forwardly over the bottom frontward projecting horizontal element.

2. The apparatus of claim 1 further including a flange element disposed connectively between a top surface of said bottom frontward projecting member and a front face of said upward projecting vertical element wherein said flange element provides rigidity to the apparatus.

3. The apparatus of claim 2 wherein said body of the apparatus comprises a single moulded body.

4. The apparatus of claim 3 wherein said moulded body is comprised of a rigid suitable thermoplastic.

5. The apparatus of claim 1 wherein the grasping element has a first concave indentation on a first side thereof and an opposite second concave indentation on a second side thereof for finger grasping of the apparatus.

6. The apparatus of claim 1 wherein said width of the bottom frontward projecting member is one inch.

7. The apparatus of claim 6 wherein the width of the downward projecting spacing element is in a range between 1.6 and 1.7 inches.

* * * * *